US005193908A

United States Patent [19]

Rescorla et al.

[11] Patent Number: 5,193,908

[45] Date of Patent: Mar. 16, 1993

[54] AGITATOR SUCTION TUBE COMBINATION

[75] Inventors: Charles L. Rescorla, Plymouth; Irving F. Snyder, Blaine, both of Minn.

[73] Assignee: Graco Inc., Minneapolis, Minn.

[21] Appl. No.: 815,701

[22] Filed: Dec. 31, 1991

[51] Int. Cl.[5] ..... B01F 15/02; B01F 7/16

[52] U.S. Cl. ..... 366/163; 366/191; 366/195; 366/247; 366/250; 261/119.1

[58] Field of Search ..... 366/102-104, 366/138, 154, 155, 163, 164, 191, 197, 199, 242, 244, 245, 247, 249, 262, 263, 265, 270, 308, 331, 342, 250, 343; 261/119.1

[56] References Cited

U.S. PATENT DOCUMENTS

| | | | |
|---|---|---|---|
| 1,623,754 | 4/1927 | Ritter | 366/247 |
| 2,146,372 | 2/1939 | Ingraham | 366/331 |
| 2,193,934 | 3/1940 | Moores | 366/102 X |
| 2,347,195 | 4/1944 | Huff . | |
| 2,592,709 | 4/1952 | Kinnaird . | |
| 3,132,850 | 5/1964 | Puchalski | 366/308 |
| 3,243,164 | 3/1966 | von Gustorf et al. | 366/262 |
| 3,322,403 | 5/1967 | Murphy | 366/247 |
| 3,358,971 | 12/1967 | Steinbock, Jr. | 366/247 X |
| 3,999,741 | 12/1976 | Richards . | |
| 4,148,101 | 4/1979 | Einhorn | 366/251 X |
| 4,168,918 | 9/1979 | de Jonge | 366/169 |
| 4,444,510 | 4/1984 | Janssen | 366/169 |
| 4,518,265 | 5/1985 | Andersson et al. | 366/318 |
| 4,676,654 | 6/1987 | Fleckner | 366/98 |
| 5,089,178 | 2/1992 | Passoni | 366/102 |

*Primary Examiner*—Harvey C. Hornsby
*Assistant Examiner*—Charles Cooley
*Attorney, Agent, or Firm*—Douglas B. Farrow

[57] ABSTRACT

A rotary agitator for use in sealed containers such as drums having a single bung opening. The agitator is provided with a housing which screws into the bung opening and appending from the housing is a rotating hollow shaft having a helical agitator flight or other agitator member which may be inserted through the bung opening. Material from inside the drum or container may be withdrawn upwardly through the hollow shaft and then outwardly through a port in the housing. A check valve is provided in the housing which communicates with the interior of the container in which to allow pressure equalization in the container which may be connected to a source of inert gas or the like to prevent degradation or other harm to the material in the drum which might be caused by ambient atmosphere.

6 Claims, 2 Drawing Sheets

AGITATOR SUCTION TUBE COMBINATION

BACKGROUND OF THE INVENTION

Agitators of various types have been known for years for insertion into drums and several types have been proposed. In U.S. Pat. No. 4,518,265 (the contents of which are herein incorporated by reference), a helical flight is located on the agitator shaft with the flight having a larger diameter than the opening in the bung hole. This allows the agitator shaft to be threaded into the bung hole and thereby obtain effective agitation. Other known agitators utilize foldable blades which may be inserted into a relatively small opening and which thence fold open to a larger diameter. In all known cases however, such agitators have required a separate tube or opening for withdrawal of the material being agitated.

SUMMARY OF THE INVENTION

It is therefore an object of this invention to provide an agitator for materials which can be inserted into a container having a single bung opening and yet which will effectively agitate and allow withdrawal of the fluid. It is further an object of this invention to provide such an agitator which in addition allows the device to work with materials which may be moisture sensitive or otherwise potentially harmed by ambient air.

The agiator of the instant invention has a hollow rotating tube having a helical flight thereon. The hollow tube is affixed in the bottom end of a transfer coupling which has an annular grove around the periphery of it which communicates via through several through bores with a hollow center. Seals are located above and below the annular groove and an outlet for it is located in a surrounding housing between axially located between the seals to communicate with the annular groove.

A bearing is located in the lower end of the housing which supports the transfer coupling. The transfer coupling has a flat on a portion of its circumference to allow it to communicate with a passage which may either be connected to a check valve in order to let air into the container from which material is being withdrawn or to allow injection of an inert gas or other material to replace fluid being used.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
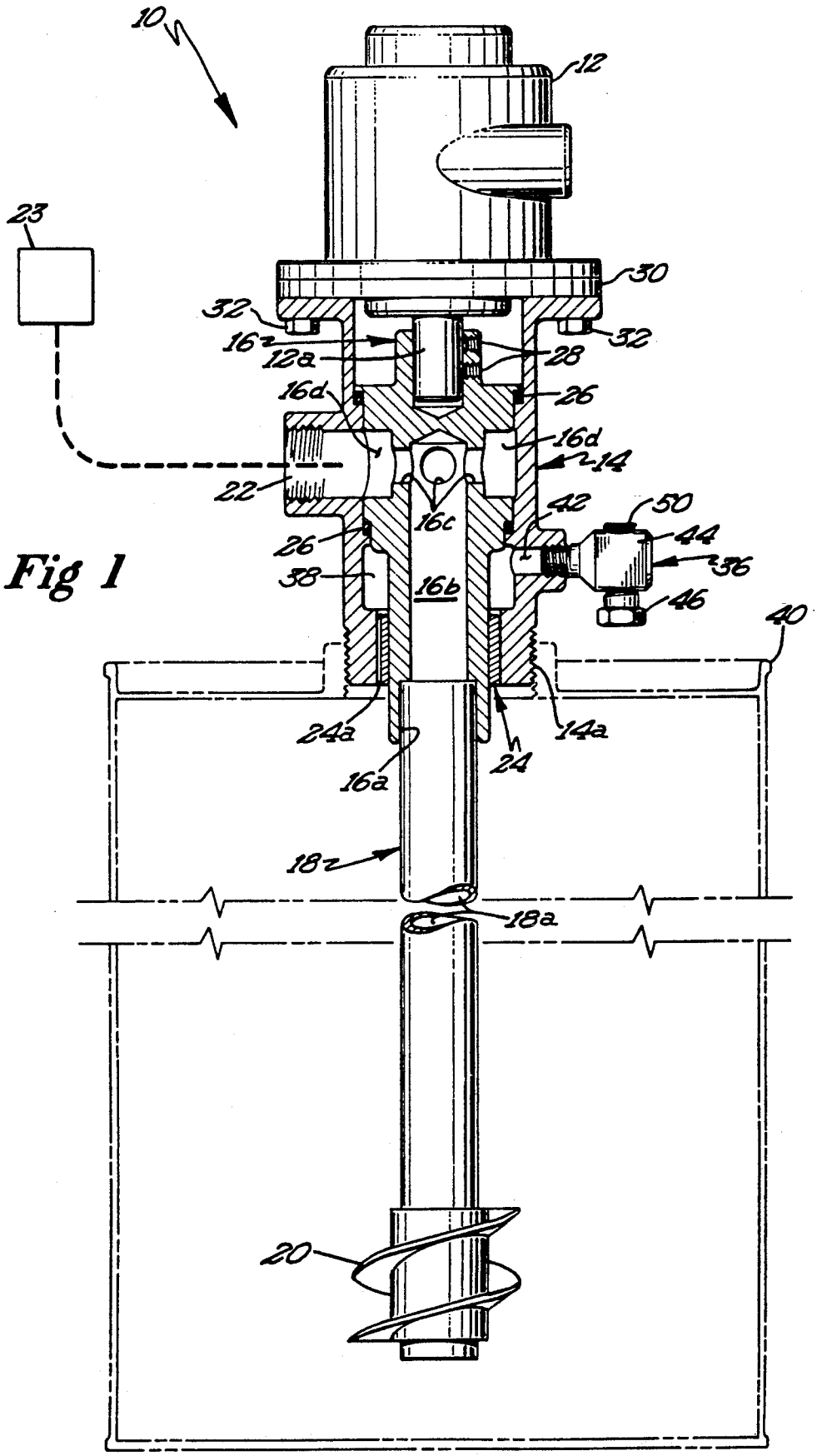
FIG. 1 is a side view partially cutaway showing the agitator of the instant invention.
Figure 2:
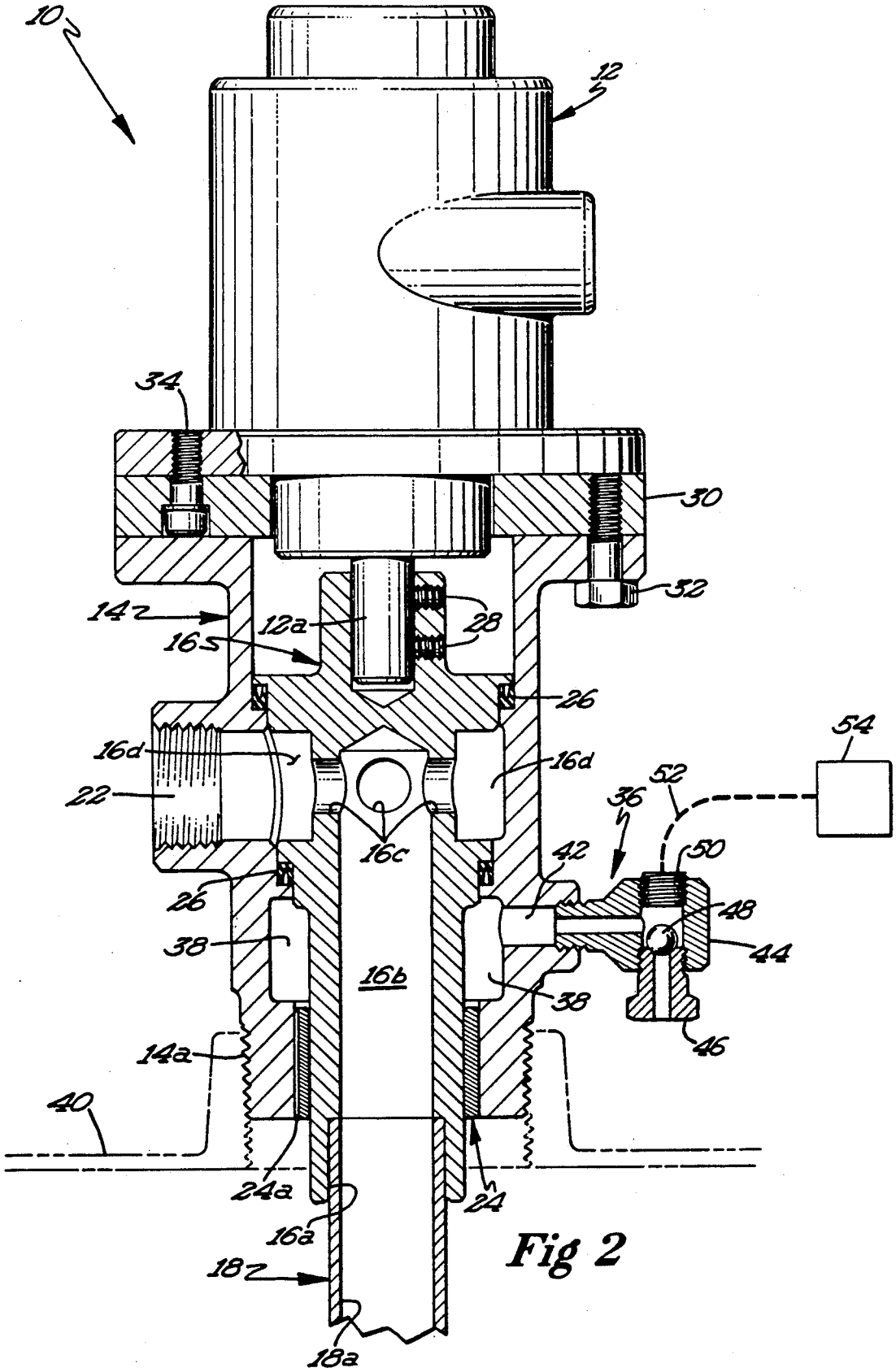
FIG. 2 is a more detailed cutaway of the transfer coupling and housing of the instant invention.

The agitator of the instant invention, generally designated 10 is shown in FIGS. 1 and 2. It is comprised of an air motor 12, a housing 14, a transfer coupling 16 and a hollow agitator shaft 18.

Agitator shaft 18 has a metal helix 20 thereon which may be attached by welding or the like. Other agitator elements such as folding or fixed blades or the like may also be utilized if desired. Housing 14 has a set of threads **14*a* on the bottom exterior thereof which are designed and sized to be screwed into a bung opening. Also located on the outside of housing 14 is an outlet port 22**.

The central bore **16*a* of transfer coupling 16 has agitator shaft 18 affixed therein by means of welding, adhesives or other conventional affixation mechanisms. A hollow interior 18*a* of shaft 18 communicates with a central passage 16*b* of transfer coupling 16. Through bores 16*c* communicate outwardly to annular transfer passage 16*d* which in turn communicates with outlet port 22. A bearing 24 is provided in the bottom of housing 14. Also, first and second seals 26 are provided near the upper and lower ends of housing 14** to provide a rotary seal.

Turning to the more detailed embodiment shown in FIG. 2, air motor 12 is provided with an air motor shaft **12*a* which is in turn affixed to transfer coupling 16 via set screws 28**. It is appreciated that other similar affixation mechanisms could be utilized such as a key, splines or the like. Such rotary air motors are available from a number of sources such as Gast.

While annular transfer passage **16*d* is provided in coupling 16, it is appreciated that a similar annular groove could be provided in housing 14 with generally the same result. Air motor 12 is affixed to housing 14 via mounting plate 30. Mounting plate 30 is attached to housing 14 via bolts 32 while mounting plate 30 is attached to air motor 12 via bolts 34**.

A makeup mechanism 36 is shown generally in FIG. 2 and is comprised of an annular passage 38 which communicates with the interior area just beneath housing 14 via a flat **24*a* on the circumference of bearing 24 thereby allowing air or other material to flow downwardly into the container 40. Makeup passage 42 connects with a t-fitting 44 which has screwed into one side a check ball seat 46 which in turn seats a check ball 48. Screwed into the other side of fitting 44 is a plug 50 or alternately a hose 52 leading to a source 54** of inert material (such as nitrogen, helium, etc.) in case the material which is to be agitated may be harmed by ambient air.

In operation, then, a pump 23 is attached to outlet port 22 wherein material from inside container 40 flows upwardly through the interior **18*a* of shaft 18, through cross bores 16*c* and into annular groove 16*d* to outlet port 22. As material is pumped from container 40, air or inert gas is introduced through makeup valve 36** to prevent formation of a vacuum.

It is contemplated that various changes and modifications may be made to the agitator without departing from the spirit and scope of the invention as defined by the following claims.

What is claimed is:

1. An agitator for use in a sealed container having material therein and a bung opening, said agitator comprising:

a housing having an interior bore and a port, said housing port being connected to a pump for withdrawing material from said container;

a generally cylindrical hollow agitator shaft in said container having first and second ends, an axial passage extending the length of said shaft and an opening in said shaft first end connected to said passage allowing material to be withdrawn from said container;

an agitator member located on said agitator shaft adjacent said shaft first end, a transfer coupling having a circumference and a bore, said coupling being rotatably mounted in said housing bore, said coupling circumference and said housing bore forming a generally annular transfer passage therebetween, said transfer passage being connected to said port and said second end of said agitator shaft being located in said coupling bore, said shaft axial passage communicating with said annular transfer passage; and a source of rotary motion connected to said coupling.

2. The agitator of claim 1 wherein said housing comprises an exterior thread for attachment in said being opening.

3. The agitator of Claim 2 further comprising a makeup port and a check valve in said housing, said makeup port communicating with the interior of said container, said check valve only allowing flow of a gas into said container.

4. The agitator of Claim 3 further comprising a source of inert gas connected to said makeup port.

5. The agitator of Claim 1 wherein said rotary motion source is an air motor.

6. The agitator of Claim 1 further comprising first and second seals between said housing and said coupling, said annular transfer passage being located between said first and second seals.

* * * * *